United States Patent [19]

Wheless

[11] Patent Number: 4,535,790

[45] Date of Patent: Aug. 20, 1985

[54] METHOD AND APPARATUS FOR ALIGNING OVAL CIGARETTE FILTERS

[75] Inventor: Jack C. Wheless, Richmond, Va.

[73] Assignee: Philip Morris Incorporated, New York, N.Y.

[21] Appl. No.: 480,809

[22] Filed: Mar. 31, 1983

[51] Int. Cl.[3] ..... A24C 5/32

[52] U.S. Cl. ..... 131/94; 131/282

[58] Field of Search ..... 131/94, 95, 282

[56] References Cited

U.S. PATENT DOCUMENTS

| | | | |
|---|---|---|---|
| 1,213,061 | 1/1917 | Baldwin . | |
| 1,608,138 | 11/1926 | Ruau . | |
| 1,995,622 | 3/1935 | Müller | 131/5 |
| 2,093,437 | 9/1937 | Gwinn | 198/25 |
| 2,118,508 | 5/1938 | Gwinn et al. | 198/24 |
| 2,162,424 | 6/1939 | Edwards | 131/39 |
| 2,165,144 | 7/1939 | Lubbock | 131/39 |
| 2,172,804 | 9/1939 | Molins | 131/39 |
| 2,188,998 | 2/1940 | Edwards | 131/94 |
| 2,786,472 | 3/1957 | Creuzberg | 131/94 |
| 2,802,470 | 8/1957 | Treble | 131/94 |
| 2,809,640 | 10/1957 | Oldenkamp | 131/94 |
| 2,918,923 | 12/1959 | Morris | 131/94 |
| 3,016,905 | 1/1962 | Creuzburg | 131/94 |
| 3,036,581 | 5/1962 | Dearsley | 131/94 |
| 3,081,778 | 3/1963 | Dearsley | 131/94 |
| 3,094,128 | 6/1963 | Dearsley | 131/94 |
| 3,269,393 | 8/1966 | Ackermann | 131/20 |
| 3,380,459 | 4/1968 | Schmermund | 131/94 |
| 3,470,884 | 10/1969 | McArthur | 131/94 |
| 3,473,536 | 10/1969 | Oesterling et al. | 131/21 |
| 3,483,873 | 12/1969 | Hinzmann | 131/23 |
| 3,506,017 | 4/1970 | Schubert | 131/94 |
| 3,518,999 | 7/1970 | Milner | 131/94 |
| 3,527,234 | 9/1970 | Hinzmann | 131/94 |
| 3,715,056 | 2/1973 | Preston | 221/211 |
| 3,878,852 | 4/1975 | Van Hall | 131/28 |
| 4,023,577 | 5/1977 | Preston et al. | 131/94 |
| 4,111,740 | 9/1978 | Molins et al. | 156/498 |
| 4,191,198 | 3/1980 | Chopko et al. | 131/76 |
| 4,238,993 | 12/1980 | Brand et al. | 131/21 R |
| 4,431,010 | 2/1984 | Seragnoli | 131/94 |
| 4,445,519 | 5/1984 | Hinz et al. | 131/94 |

FOREIGN PATENT DOCUMENTS

| | | | |
|---|---|---|---|
| 1049283 | 1/1959 | Fed. Rep. of Germany . | |
| 1911102 | 9/1970 | Fed. Rep. of Germany . | |
| 682379 | 2/1965 | Italy . | |
| 317491 | 7/1929 | United Kingdom . | |
| 0687878 | 2/1953 | United Kingdom | 131/94 |
| 0856723 | 12/1960 | United Kingdom | 131/94 |

*Primary Examiner*—V. Millin

*Attorney, Agent, or Firm*—Jeffrey H. Ingerman

[57] ABSTRACT

A method and apparatus are disclosed for taking rod-shaped articles of oval cross section, such as oval filter plugs for cigarettes, from a hopper, with a predetermined spacing between consecutive articles, and for presenting the articles at a destination with a predetermined orientation. A plug drum having flutes shaped to accept a single oval filter plug in any angular orientation is used to remove the filter plug from the hopper. When each filter plug is released from the plug drum, it drops through a guideway preferably defined between two cooperating elements, which permit it to pass through only with a specific orientation. At the discharge end of the guideway is preferably a second drum, which has flutes shaped to accept a filter plug leaving the guideway only in the desired final orientation.

13 Claims, 8 Drawing Figures

METHOD AND APPARATUS FOR ALIGNING OVAL CIGARETTE FILTERS

BACKGROUND OF THE INVENTION

The present application pertains generally to methods and apparatus for tipping smoking articles, and pertains more especially to such methods and apparatus for tipping oval smoking articles.

In the manufacture of cigarettes, it is conventional to make a continuous tobacco rod (a paper tube filled with shredded tobacco or tobacco substitute) and to cut the continuous rod to the length of individual cigarettes. A continuous rod of filter material is extruded and cut into lengths. The resulting filter plugs are collected in trays and placed in the hopper of a tipping machine, which cuts the filter plugs to twice the length of a single filter, joins each double-length filter plug to two filterless cigarettes and severs the resulting assembly to form two complete cigarettes.

The filter plugs are gravity-fed from the hopper into flutes or grooves in the periphery of a rotating drum. The filter plugs are held in place in the flutes by means of vacuum suction exerted from the drum interior. The filter plugs can be passed from one such drum to another by proper timing of the rotations of the two drums, and by simultaneously deactivating the suction applied to a particular groove of the first drum as that groove comes face-to-face with a groove of the second drum. This permits a filter plug in the first flute to be pulled over into the opposing flute of the second drum by the suction applied to the latter. The filter plugs passed in this manner from one drum to another eventually are transferred to the flutes of a feed drum. In each flute two previously-deposited cigarette rods flank the filter plug end-to-end.

A web of cork or other tipping material is drawn from a roll thereof and has glue applied to one side. The web is cut off in lengths by cork knives, and one edge of each length is applied to a filter-plug-and-cigarette assembly in such a manner as to extend over the entire length of the filter plug and to overlie a small portion of each cigarette rod, the adhesive on the tipping material sticking to the plug and the rod.

The resulting double cigarette assembly is transferred to a rolling drum, beside which is a metallic rolling block. Each cigarette assembly is rolled along the rolling block while being moved by the drum. The rolling action wraps the tipping material around the cigarette assembly, to which it adheres as a result of the glue. Suitable heating elements in the rolling block commonly are used to cure the adhesive rapidly.

The double cigarette assembly is then transferred to a cutter drum, which moves it past a disc knife that severs the assembly into two complete cigarettes. The cigarettes are then inspected and moved to a discharge point, from which they are taken to another machine for packing.

The conventional tipping machine described above is designed to handle cigarettes of circular cross section. It would be desirable to be able to adapt a standard cigarette tipping machine for use in the rapid, economical large-scale manufacture of cigarettes having an oval cross section, which have hitherto largely been a luxury product requiring special equipment for virtually every step of their manufacture. Two particular problems arise in making such an adaptation. First, it is difficult to transfer oval filter plugs from the hopper to a drum of the conventional type in such a manner that every flute will contain a filter plug and so that each filter plug will have the same predetermined orientation about its longitudinal axis (hereinafter, "angular orientation"). Second, it has been found to be impossible, as a practical matter, to wrap tipping material around a cigarette assembly having an oval cross section, using standard tipping machine equipment.

Related copending application Ser. No. 584,366 filed Feb. 28, 1984, which is a continuation-in-part of related copending application Ser. No. 480,807, filed Mar. 31, 1983, both, entitled "Method and Apparatus for Tipping Oval Smoking Articles," assigned in common herewith, and the entire contents and disclosure of which are incorporated herein by reference, are directed to a solution of the second problem. The present invention is a solution of the first problem.

It is therefore the principal object of the invention to provide a method and apparatus for giving a filter plug of oval cross section a predetermined angular orientation.

Another object of the invention is to provide such a method and apparatus by means of which it is possible to take an oval filter plug from a hopper containing a large number of such articles and to give it the desired angular orientation.

Yet another object of the invention is to achieve the foregoing objects in a manner which permits the ready and easy adaptation of existing tipping machines to the production of oval cigarettes.

SUMMARY OF THE INVENTION

According to the invention, a plug drum is located at the lower opening of the hopper and is provided with specially shaped flutes in its periphery to receive one oval filter plug each, in any orientation. At one side of the hopper mouth is a refuser roller which rotates about a horizontal axis in the same direction as the plug drum and is spaced a small distance from the plug drum, defining a seating zone associated with each flute. The seating zone is the area within which a plug in the flute must be to avoid striking the refuser roller.

Beneath the plug drum are preferably two guide elements which define a guideway between them to receive filter plugs released from the plug drum and give them a predetermined angular orientation. Beneath the guide elements is a grading drum, whose periphery is preferably formed with specially shaped troughs in which an oval filter plug of a given size can only be received in one angular orientation.

The filter plugs in the hopper fall into the flutes of the plug drum due to gravity, and are retained there, preferably by suction. The rotation of the plug drum brings each plug to a position directly above one guide element. According to the preferred embodiment, the suction on the filter plug is terminated at that point, and the filter plug falls through the guideway defined by the guide elements. The rotation of the plug drum and of the grading drum is synchronized in such a manner that each filter plug, given a predetermined orientation by the guideway, falls into one of the flutes of the grading drum with the desired angular orientation, i.e., with the major axis of the filter plug cross sections approximately perpendicular to the radius of the grading drum.

It is to be understood that the term "oval" as used herein includes not only elliptical cross-sections but all others, symmetric or not, that are substantially longer in one dimension than in the other.

These and other objects and features of the invention will become clearer upon a consideration of the following detailed description of the preferred embodiment of the invention, taken in conjunction with the accompanying figures, in which like reference characters refer to like elements throughout.

DETAILED DESCRIPTION OF THE PREFERRED EMBODIMENT

A tipping machine incorporating the invention moves oval filter plugs from a hopper along a path on which they are cut to twice the length of a single filter and mated end to end with oval filterless cigarettes supplied from a cigarette maker. Tipping material in sheet form, such as cork or tipping paper, is drawn from a roll and has an adhesive applied to one side of it. The tipping material is then cut into lengths, each of which is attached to an assembly comprising two filterless cigarettes abutting a double-length filter plug between them end-to-end. The rolling drum assembly of the present invention is used to wrap the piece of tipping material around the oval cigarette assembly, firmly securing the filter plug to the tobacco rods. The cigarette assembly is then cut into two oval cigarettes and delivered to the output point of the tipping machine to be transported to the next work station.

Except for the plug drum, all drums that would conventionally have flutes of circular-arcuate cross section instead preferably have oval-arcuate flutes to receive the oval articles in question snugly.

Figure 1:
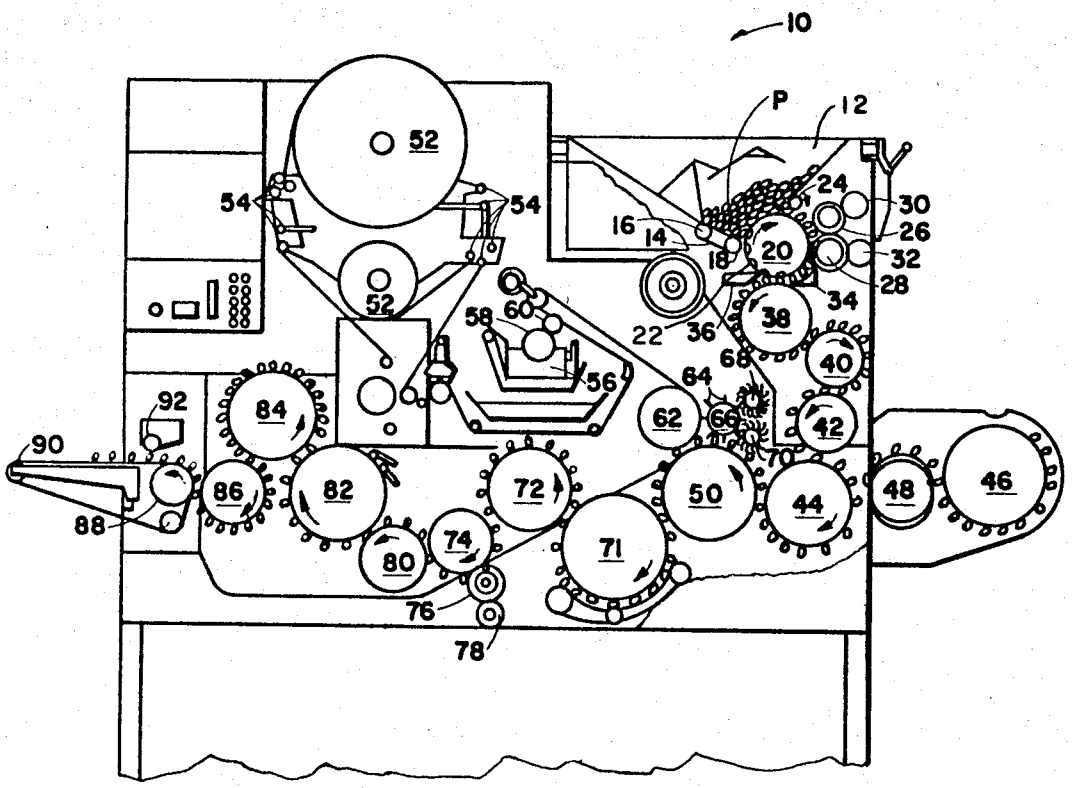
FIG. 1 is a somewhat schematic elevational view of a tipping machine incorporating apparatus for carrying out the method of the invention.

FIG. 1 shows a overview of such a tipping machine 10. The tipping machine 10 has a hopper 12 in which filter plugs P four times or six times as long as needed for one cigarette are received. Adjacent the bottom opening of the hopper 12, on one side, is a continuous belt 14 mounted on two rollers 16, 18, which drive the belt 14 so as to feed filter plugs downward toward the bottom opening of the hopper 12.

A plug drum 20 is mounted for rotation about a horizontal axis below the bottom opening of the hopper 12. The plug drum 20 has evenly spaced flutes 22 around its circumference and includes a conventional mechanism in its interior for applying vacuum suction to selected flutes 22. As the filter plugs reach the bottom of the hopper 12, each is received in a flute 22 on the plug drum 20 and is held there by means of suction. The rotation of the drum 20 carries the plug out of the hopper 12. To prevent filter plugs not firmly seated in flutes 22 from leaving the hopper 12, a refuser roller 24 is disposed adjacent the hopper opening on the side toward which the filter plugs move as they leave the hopper, i.e., the side opposite the feeder belt 14. The refuser roller 24 rotates in such a direction as to tend to knock filter plugs back into the hopper 12 (clockwise in FIG. 1), and is spaced from the plug drum 20 such a distance that a filter plug seated in a flute 22 will clear the refuser roller 24 while a filter plug lying on the periphery of the drum and not in a flute 22 will be kept in the hopper 12 by the refuser roller 24.

Adjacent the plug drum 20 are two slitter disc knives 26, 28 mounted for rotation about respective horizontal axes. The knives 26, 28 are positioned so as to cut each filter plug into three segments of equal length. (If the filter plugs in the hopper 12 are only four times the length of one filter, only one of the two slitter knives shown is needed.) Grinding wheels 30, 32 adjacent each slitter disc 26, 28 sharpen the knives.

Two guide blocks 34, 36 below the plug drum 20 are used to give each oval filter plug the same angular orientation, as described below (See FIG. 2). Upon emerging from between the guide blocks 34, 36, the filter plugs are received on a grading drum 38, which staggers the two or three filter plugs cut from one original plug. After staggering the plugs, the grading drum 38 transfers them in a known manner to a shifting drum 40, where vacuum suction is used in known manner to draw each filter plug toward the axially middle portion of the drum 40, thus combining the two or three staggered parallel series of filter plugs into a single series. The filter plugs are then transferred in the known manner to an accelerating drum 42, which accelerates them to the desired speed and passes them conventionally to the feed drum 44.

At the same time, oval tobacco rods cut to the length of individual cigarettes are received from a cigarette maker. The maker feeds the filterless tobacco rods individually in staggered relationship, longitudinally onto a take-off drum 46. The single-length filterless cigarettes then pass in the known way to the grading drums 48, were the individual cigarettes are transferred to permit alignment for transfer to the feed drum 44. The separator drum 48 then transfers them in the known way to the feed drum 44, on which the filter plugs are then placed in the manner described. The resulting combination of filter plug and cigarettes is moved to the swash-plate drum 50, on which the cigarettes are moved toward each other so that they abut the filter plug end-to-end. While on this drum 50, the resulting double cigarette assembly (the combination of filter plug and tobacco rods) receives a piece of adhesive-coated tipping material.

The tipping material is supplied in the following known manner. A roll 52 of tipping material is mounted for rotation about a horizontal axis. (Two rollers 52 are shown. As one is used up, the second is spliced to the first.) The material is pulled from the roll 52 and is led along a path defined by various rollers 54, a bath 56 of adhesive, which is preferably heat-activatable. A roller 58 partially immersed in the bath 56 and rotating about a horizontal axis coats an adjacent applicator roller 50 with adhesive. The tipping material web is passed along the surface of the applicator roller 60 so that one surface of the web is coated with the adhesive. The tipping material is then transported to the cork drum 62, which serves as a platen to permit the tipping material, held against the drum 62 by suction, to be cut into lengths by means of knives 64 mounted on a rotating knife drum 66. Rotary brushes 68, 70 adjacent the cork knife drum 66 remove debris, dust and the like from the cork knives 64.

The rotation of the cork drum 62 brings each piece of tipping material, with the adhesive side exposed, into contact with a cigarette assembly on the swashplate drum 50. The cork drum suction on the tipping material is terminated at the moment of contact with the cigarette assembly, to which the adhesive sticks. The material contacts and adheres to the assembly along a single line, and extends from the assembly like a tab. The tipping material is then wrapped around the assembly by the rolling drum 71 of the invention, as described in detail in copending application Ser. Nos. 480,807 and 584,366.

After completion of the wrapping process, the cigarette assemblies are passed to a transfer drum 72 and thence to a cutting drum 74 adjacent which is a slitter disc knife 76. The slitter knife 76 cuts each double cigarette assembly into two cigarettes. A grinder wheel 78 adjacent the slitter disc knife 76 maintains its sharpness. The cigarettes are then moved by an additional transfer drum 80 to a turning drum 82, which reverses one of the two parallel mirror-image series of cigarettes so that all the cigarettes have the same orientation. The cigarettes proceed to an inspection drum 84, thence to an ejection drum 86 that removes any cigarette identified as defective, and finally to a catcher drum 88 that places the remaining cigarettes on two catcher belts 90 to be taken to the next machine. A guide wheel 92 above the belts 90 decelerates the cigarettes as they are placed on the belts 90.

Figure 2:
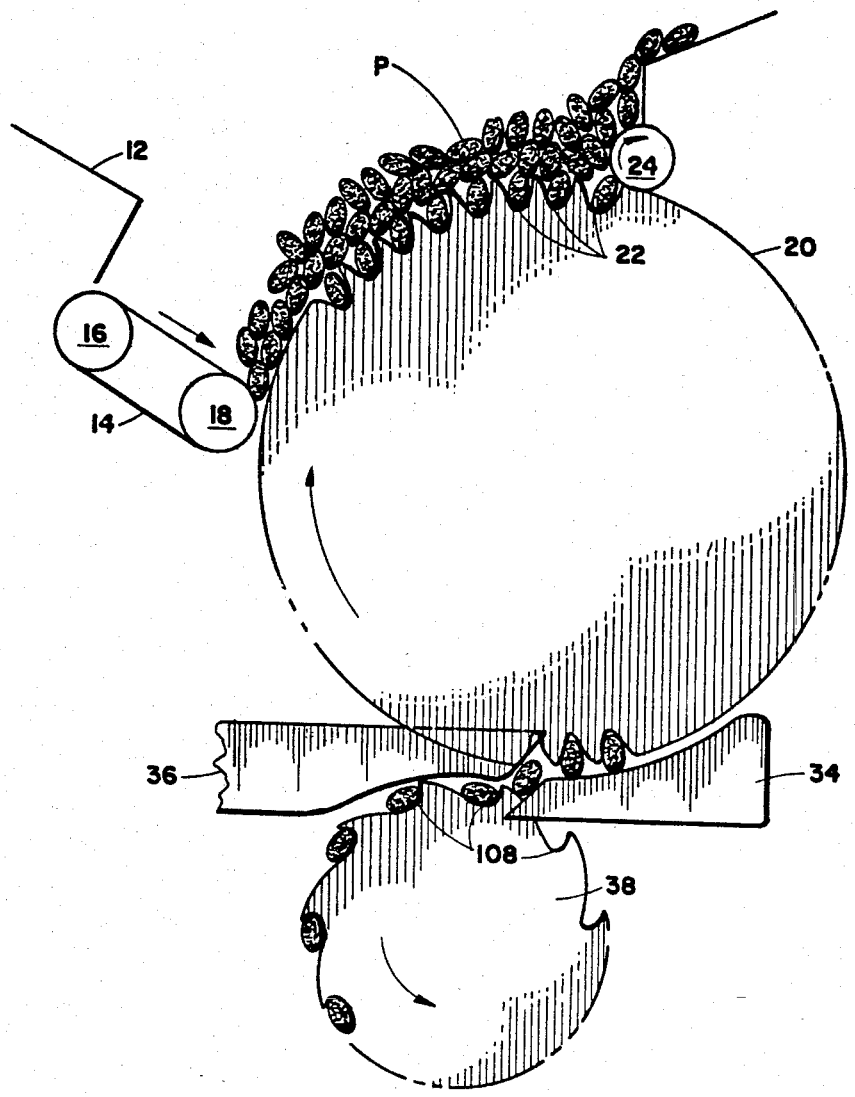
FIG. 2 is a detail of FIG. 1 showing the preferred embodiment of the apparatus for carrying out the method of the invention.
Figure 3:
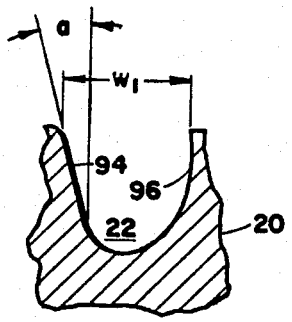
FIG. 3 is a detail of FIG. 2.

FIG. 2 shows the flutes 22 in the plug drum periphery each receiving a filter plug P with the major axis of the plug generally parallel to the plug drum radius (hereinafter , the "radial orientation"). In practice, it is extremely unlikely that every filter plug would be received in a flute with the same orientation. The flutes 22 of the plug drum 20 are so shaped that each flute 22 can receive a filter plug P in any angular orientation whatever, and yet cannot accept more than one filter plug in such a way as to clear the refuser roller 24. According to the invention, this is achieved by shaping the flutes 22 of the plug drum 20 as shown in FIG. 3. The flute 22 must be wide enough to accept a filter plug in any orientation and must in particular have a maximum width W1 greater than the major axis of the filter plug cross section. At the same time, the flute 22 must be deep enough to receive the filter plug parallel to the radius of the plug drum (hereinafter, the in the radial orientation), sufficiently deeply so that the plug will clear the refuser roller 24. In addition, the deepest portion of the flute must be narrow enough that only one filter plug can be received in the radial orientation despite the wide mouth of the flute 22. These requirements are met by the flute shape shown in FIG. 3.

As shown, the mouth of the flute 22 is slightly wider than twice the major semiaxis R of the filter plugs with which the machine will be used. At its maximum depth, the flute 22 is somewhat deeper than R. Particularly, the back edge of the flute 22 is inclined at a small angle a to the radius of the plug drum 20. In the version shown, the angle a is about 15 degrees. Near the point of maximum depth of the flute 22, the back wall 94 smoothly joins the bottom of the flute 22. This portion of the bottom has a radius of curvature of approximately one eighth of R. Forward of this, the radius of curvature increases to about one fourth of R. The front wall 96 of the flute 22 is more or less radial. When the flutes 22 have the dimensions indicated, it has been found that the plugs fall into the flutes from the hopper easily and without jamming, and when released from the plug drum 20, proceed easily and without jamming into the guideway defined by the guide blocks 34, 36.

Figure 4:
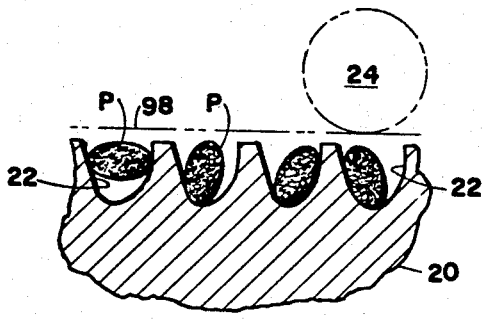
FIG. 4 is an additional detail of FIG. 2.

As can be seen from FIG. 4, the flutes 22 are capable of receiving a filter plug in any angular orientation, with its major axis either radial or perpendicular ("tangential orientation") to the drum radius or at any intermediate angle. Regardless of the orientation, the filter plug is received sufficiently low in the flute 22 to clear the refuser roller 24, i.e., the plug is entirely in a zone that will hereinafter be termed the "seating zone". If a second plug is also received in the flute, however, it will inevitably protrude above the line 98 of the refuser roller 24 and will be knocked back into the hopper 12.

Figure 5:
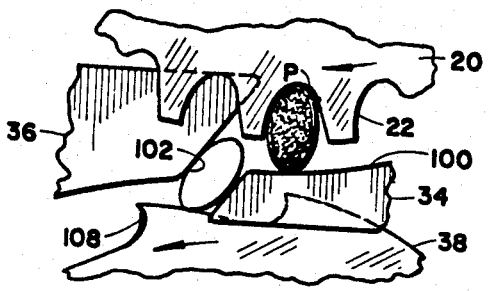
FIGS. 5–8 are details of FIG. 1 showing one portion of the preferred embodiment.

FIGS. 5–8 illustrate the functioning of the guide blocks 34, 36 and the grading drum 38. As indicated in FIG. 5, when a flute 22 bearing a filter plug P approaches the lowest point in its revolution about the plug drum axis, the suction applied to that flute is deactivated, allowing the filter plug P to fall onto the first guide block 34. The clearance between the plug drum 20 and the first guide block 34 is sufficiently small that, regardless of the orientation of the plug P in the flute 22, the released filter plug will be swept along the top of the first guide block 34 toward the guideway by the rotation of the plug drum 20, as indicated in FIG. 5. For this purpose, the upper surface 100 of the first guide block 34 is slightly concave.

Figure 6:
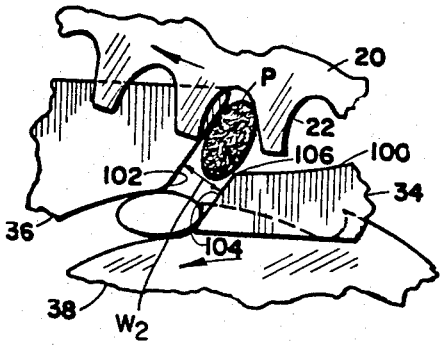

The far side of the guideway is defined by a surface 102 of the second guide element 36 substantially parallel to the near side 104 of the guideway. The motion of the plug drum 20 brings the filter plug P to the lip 106 of the guideway. Due to the curvature of the lip 106, the motion of the plug drum 20 pushes the filter plug over the lip 106, against the second guide block 36 and into the guideway. The filter plug slips down the guideway with its major axis parallel to the guideway axis, as shown in FIG. 6. The width W2 of the guideway is slightly greater than the minor axis of the oval plug cross section, so that the filter plug P falls onto the grading drum 38 with an angular orientation determined by inclination of the guideway, as shown in FIG. 7.

Figure 8:
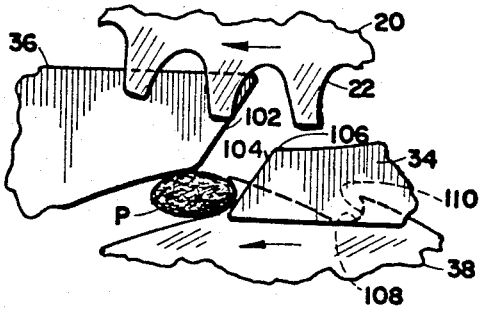

The grading drum 38 is provided with flutes 108 that, in profile, somewhat resemble the teeth of a circular saw blade. The back wall 110 of each flute 108 of the grading drum 38 is shaped precisely to receive the thin end of the cross section of the filter plug P, as indicated in FIGS. 6 and 8, so that the major axis of the plug is nearly but not exactly perpendicular to the grading drum radius. The lower surface 112 of the flute 108 slopes gradually radially outward to the back wall of the next flute 108.

Figure 7:
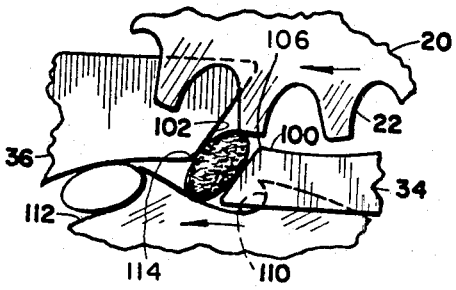

The rotation of the plug drum 20 and the grading drum 38 is synchronized in such a manner that a plug leaving the guideway strikes a portion of the inclined lower and front wall 112 of a flute 108 of the grading drum 38, as shown in FIG. 7. The rotation of the grading drum 38 moves the lower portion of the filter plug around the lower lip 114 of the second guide block 36, repositioning the filter plug in a substantially tangential orientation on the grading drum 38.

Once the filter plug P is nested against the back wall 110 of the grading drum flute 108, as shown in FIG. 8, vacuum suction maintains the filter plug in the desired orientation for delivery to the shifting drum 40.

The present invention has been tested on a tipping machine with great success, at speeds (up to 5,000 cigarettes per minute) comparable to production attainable with conventional equipment and ordinary filter plugs of circular cross section.

Although the invention has been particularly described in detail with reference to one perferred embodiment thereof, many modifications and variations of that embodiment will now be apparent to those skilled in the art. Accordingly, the scope of the invention is to be limited not by the details of the illustrative embodiment disclosed herein, but only by the terms of the appended claims.

I claim:

1. A cigarette tipping machine comprising: a hopper; feed means for receiving filter plugs of oval cross section from said hopper for presenting the filter plugs at a predetermined point with a predetermined angular orientation; said feed means comprising a plug drum located adjacent said hopper for receiving filter plugs at predetermined locations about the peripheral surface of said plug drum, said plug drum including means for retaining filter plugs thereon at said predetermined locations; said plug drum having a respective flute at each said predetermined location for receiving a filter plug therein within a predetermined seating zone; refuser means for preventing a filter plug received in one said flute but protruding from the respective said seating zone from leaving said hopper; a plurality of rotating drum means for transporting the filter plugs along a predetermined path from said predetermined point; said rotating drum means each having a plurality of flutes in their peripheral surfaces, each said flute having an oval shape to fit the oval filter plugs with which said machine is to be used; means for supplying oval tobacco rods and aligning them with respective filter plugs; and means for applying tipping material to assemblies comprising a filter plug and a tobacco rod, for securing the filter plug to the tobacco rod.

2. A cigarette tipping machine comprising: a hopper; feed means for receiving filter plugs of oval cross section from said hopper for presenting the filter plugs at a predetermined point with a predetermined angular orientation; said feed means comprising a plug drum located adjacent said hopper for receiving filter plugs at predetermined locations about the peripheral surface of said plug drum, said plug drum including means for retaining filter plugs thereon at said predetermined locations; said plug drum having a respective flute at each said predetermined location for receiving a filter plug therein within a predetermined seating zone, each said plug drum flute having a maximum width and a maximum depth greater than the maximum dimension of the cross section of the filter plugs, and a narrow portion narrower than said maximum dimension of the filter plugs, for accepting at most one such filter plug in said flute entirely within said seating zone thereof; refuser means for preventing a filter plug received in one said flute but protruding from the respective said seating zone from leaving said hopper; a plurality of rotating drum means for transporting the filter plugs along a predetermined path from said predetermined point; said rotating drum means each having a plurality of flutes in their peripheral surfaces, each said flute having an oval shape to fit the oval filter plugs with which said machine is to be used; means for supplying oval tobacco rods and aligning them with respective filter plugs; and means for applying tipping material to assemblies comprising a filter plug and a tobacco rod, for securing the filter plug to the tobacco rod.

3. The tipping machine of claim 1, wherein said feed means further comprises alignment means for receiving filter plugs at predetermined intervals from said plug drum and for aligning them in said predetermined orientation for presentation at said predetermined point.

4. A cigarette tipping machine comprising: a hopper; feed means for receiving filter plugs of oval cross section from said hopper for presenting the filter plugs at a predetermined point with a predetermined angular orientation; said feed means comprising a plug drum located adjacent said hopper for receiving filter plugs at predetermined locations about the peripheral surface of said plug drum and alignment means for receiving filter plugs at predetermined intervals from said plug drum and for aligning them in said predetermined orientation for presentation at said predetermined point, said plug drum including means for retaining filter plugs thereon at said predetermined locations and said alignment means defining a guideway for receiving filter plugs from said plug drum, said alignment means having a first surface for supporting a filter plug that has been released by said plug drum while the filter plug is moved by the continuing rotation of said plug drum toward said guideway; said plug drum having a respective flute at each said predetermined location for receiving a filter plug therein within a predetermined seating zone; refuser means for preventing a filter plug received in one said flute but protruding from the respective said seating zone from leaving said hopper; a plurality of rotating drum means for transporting the filter plugs along a predetermined path from said predetermined point; said rotating drum means each having plurality of flutes in their peripheral surfaces, each said flute having an oval shape to fit the oval filter plugs with which said machine is to be used; means for supplying oval tobacco rods and aligning them with respective filter plugs; and means for applying tipping material to assemblies comprising a filter plug and a tobacco rod, for securing the filter plug to the tobacco rod.

5. The tipping machine of claim 4, wherein said alignment means has a second surface for being engaged by a filter plug moving on said first surface with the major axis of the filter plug cross section parallel to said first surface, for turning the filter plug into said guideway with a second predetermined angular orientation in cooperation with said plug drum.

6. The tipping machine of claim 5, wherein said alignment means comprises first and second blocks defining said guideway between them, said first block having an upper surface which is said first surface, and said second surface being continuous and flush with the portion of said second block defining said guideway in cooperation with said first block.

7. The tipping machine of claim 4, wherein said alignment means further comprises a grading drum having additional flutes on its peripheral surface, said additional flutes being shaped to receive filter plugs therein in said predetermined orientation; said grading drum being for transporting the filter plugs thereon to said predetermined point.

8. The tipping machine of claim 7, wherein each said additional flute has a back wall shaped to receive the portion of a filter plug lying at one end of the major axis of the cross section thereof, said predetermined angular orientation being with said major axis generally perpendicular to the radius of said grading drum.

9. A plug drum for a cigarette tipping machine to be used with pre-made oval filter plugs, comprising a cylindrical drum having a plurality of paraxial flutes disposed on its peripheral surface at equal intervals therearound; each said flute having a maximum depth greater than the maximum cross-sectional dimension of the filter plugs to be used with said plug drum and having a first portion adjacent said peripheral surface and wider than said maximum dimension and a second portion radially inward from said first portion and narrower than said maximum dimension, and means in said plug drum for selectively retaining a filter plug in one of said flutes and for releasing a filter plug therefrom.

10. In combination, the plug drum of claim 9, first and second elements defining a guideway therebetween for receiving a filter plug released from said plug drum and imparting a predetermined first angular orientation to the filter plug, said first element having a first surface adjacent said plug drum and sufficiently close thereto that when said plug drum releases a filter plug, the filter plug rides on said first surface and is moved therealong toward said guideway by the rotation of said plug drum.

11. The combination of claim 10, further comprising a grading drum having flutes parallel to said flutes of said plug drum, for receiving filter plugs from said guideway in said first angular orientation, said flutes of said grading drum being shaped to cooperate with said second element to turn each filter plug so received from said first angular orientation to a predetermined second angular orientation; said grading drum having means for retaining a filter plug in one of said flutes of said grading drum in said second angular orientation.

12. A method for aligning rod-shaped articles of oval cross section, comprising the steps of: receiving such an article, with any angular orientation, on the periphery of a rotatable element; rotating said rotatable element to bring said article to a predetermined point; then separating said article from said rotatable element and moving said article through a stationary guideway in which said article can fit in only one angular orientation for passage to a second rotatable element.

13. A method for aligning rod-shaped articles of oval cross section, comprising the steps of: receiving such an article, with any angular orientation, on the periphery of a rotatable element; rotating said rotatable element to bring said article to a predetermined point; then separating said article from said rotatable element by placing said article on a surface adjacent to said rotatable element, and moving said article into a guideway in which said article can fit in only one angular orientation by moving said article along said surface, over an edge of said surface and into said guideway, the width of said guideway being slightly greater than the minimum cross-sectional dimension of said article.

* * * * *

UNITED STATES PATENT AND TRADEMARK OFFICE

CERTIFICATE OF CORRECTION

PATENT NO. : 4,535,790

DATED : August 20, 1985

INVENTOR(S) : Jack C. Wheless

It is certified that error appears in the above-identified patent and that said Letters Patent is hereby corrected as shown below:

Column 4, line 36, "were" should be --where--;

line 53, after "54," should be inserted --past--.

Column 5, line 46, "the" (first occurrence) should be deleted.

Signed and Sealed this

Fourteenth Day of April, 1987

*Attest:*

DONALD J. QUIGG

*Attesting Officer*

*Commissioner of Patents and Trademarks*